US009867432B1

(12) United States Patent
Wu

(10) Patent No.: US 9,867,432 B1
(45) Date of Patent: Jan. 16, 2018

(54) SAFETY BELT BUCKLE FOR RACE CAR

(71) Applicant: TAIWAN RACING PRODUCTS CO., LTD., Hemei Township, Changua County (TW)

(72) Inventor: Wen-Yuan Wu, Dacun Township (TW)

(73) Assignee: Taiwan Racing Products Co., Ltd., Hemei Township (TW)

( * ) Notice: Subject to any disclaimer, the term of this patent is extended or adjusted under 35 U.S.C. 154(b) by 0 days.

(21) Appl. No.: 15/248,009

(22) Filed: Aug. 26, 2016

(51) Int. Cl.
*A44B 11/25* (2006.01)
*B60R 22/18* (2006.01)

(52) U.S. Cl.
CPC ..... *A44B 11/2549* (2013.01); *A44B 11/2542* (2013.01); *B60R 2022/1806* (2013.01); *B60R 2022/1812* (2013.01); *Y10T 24/45618* (2015.01)

(58) Field of Classification Search
CPC ..... A44B 11/2549; A44B 11/2542; Y10T 24/45628; Y10T 24/45634; Y10T 24/45618
See application file for complete search history.

(56) References Cited

U.S. PATENT DOCUMENTS

| | | | | |
|---|---|---|---|---|
| 2,921,353 A * | 1/1960 | Cushman | A44B 11/2542 24/632 |
| 4,656,700 A * | 4/1987 | Tanaka | A44B 11/2542 24/579.11 |
| 7,065,843 B1 * | 6/2006 | Wu | A44B 11/2542 24/631 |
| 2010/0244424 A1 * | 9/2010 | Kranz | A44B 11/2542 280/808 |
| 2011/0010901 A1 * | 1/2011 | Holler | A44B 11/2542 24/593.1 |
| 2012/0284966 A1 * | 11/2012 | Greaves | A44B 11/2511 24/170 |
| 2013/0212845 A1 * | 8/2013 | Ford | A44B 11/2569 24/602 |

* cited by examiner

*Primary Examiner* — Robert J Sandy
(74) *Attorney, Agent, or Firm* — Alan D. Kamrath; Kamrath IP Lawfirm, P.A.

(57) ABSTRACT

A safety belt buckle includes a base unit, a driving unit mounted on the base unit, and a torque device mounted on the driving unit. The base unit is provided with a plurality of insertion slots, a rotation shaft, and a positioning portion. The driving unit includes a circular cap and a driving handle. The torque device includes a ring, two balls, two compression springs and a fixed plate. In practice, when the driving handle is driven by a user, the circular cap is rotated to operate the two compression springs which press the two balls to increase a resistance to the circular cap, and to obstruct rotation of the driving unit, thereby preventing the driving unit from being driven freely by an external force.

9 Claims, 9 Drawing Sheets

SAFETY BELT BUCKLE FOR RACE CAR

BACKGROUND OF THE INVENTION

1. Field of the Invention

The present invention relates to a safety belt buckle and, more particularly, to a safety belt buckle for a race car.

2. Description of the Related Art

A conventional safety belt buckle for a race car comprises a main body, a rotary drive member and a fastening member. The main body has a periphery provided with five insertion slots and has a top having a center provided with a post which is provided with a square drive portion which is provided with a screw hole. The top of the main body is provided with a limit block located beside the post. A locking device is mounted in the main body and is controlled by rotation of the post. The rotary drive member includes a circular disk and a drive handle extending from the circular disk. The circular disk has a top having a center provided with a circular recess which has a face provided with a square mounting hole. The circular disk has a bottom provided with an arcuate limit slot located beside the square mounting hole. In assembly, when the rotary drive member is mounted on the main body, the square mounting hole of the rotary drive member is mounted on the square drive portion of the post of the main body, and the arcuate limit slot of the rotary drive member is mounted on the limit block of the main body. The fastening member is screwed into the screw hole of the post of the main body so that the rotary drive member is combined with the post of the main body. When in use, a latch plate of a safety belt is inserted into one of the insertion slots of the main body and is locked by the locking device. When the rotary drive member is rotated, the post of the main body is rotated to drive the locking device so as to unlock the latch plate of the safety belt from the locking device and to release the latch plate of the safety belt. At this time, the arcuate limit slot of the rotary drive member and the limit block of the main body restrict the rotation angle of the rotary drive member. However, rotation of the rotary drive member directly drives and rotates the post of the main body so that when the rotary drive member is driven by an external force due to an unintentional touch or hit, the latch plate of the safety belt will be unlatched and released easily, thereby causing danger to the user.

BRIEF SUMMARY OF THE INVENTION

The primary objective of the present invention is to provide a safety belt buckle that cannot be unlocked easily and freely.

In accordance with the present invention, there is provided a safety belt buckle comprising a base unit, a driving unit mounted on the base unit, and a torque device mounted on the driving unit. The base unit is provided with a plurality of insertion slots, a rotation shaft, and a positioning portion. The rotation shaft has a top provided with a drive portion. The positioning portion has an annular wall surrounding the rotation shaft. The annular wall of the positioning portion has a height greater than that of the drive portion of the rotation shaft and has a periphery provided with a first protrusion and a second protrusion. The driving unit includes a circular cap and a driving handle extending from the circular cap. The circular cap of the driving unit has a bottom provided with a receiving chamber. The receiving chamber of the circular cap is provided with a receiving recess corresponding to the annular wall of the positioning portion. The receiving recess of the circular cap has a periphery provided with a first channel and a second channel and has a center provided with a fixing portion. The torque device includes a ring mounted in the receiving recess of the circular cap and having a periphery provided with a first depression, a second depression, a first ball groove and a second ball groove, two balls respectively mounted in the first channel and the second channel of the circular cap and partially received in the first ball groove and the second ball groove of the ring respectively, two compression springs respectively mounted in the first channel and the second channel of the circular cap and biased between the circular cap of the driving unit and the two balls respectively, and a fixed plate secured in the receiving chamber of the circular cap and provided with a connecting hole corresponding to the annular wall of the positioning portion. In practice, when the driving handle of the driving unit is driven by a user, the circular cap of the driving unit is rotated to operate the two compression springs which press the two balls of the torque device to increase a resistance to the circular cap of the driving unit, and to obstruct rotation of the driving unit, thereby preventing the driving unit from being driven freely by an external force.

According to the primary advantage of the present invention, the user has to apply a determined force to overcome the resistance of the two compression springs and to drive the driving unit, so as to release the latch plate of the safety belt, thereby preventing the driving unit from being driven freely by an external force due to an unintentional touch or hit, and thereby preventing the latch plate of the safety belt from being unlatched easily, so as to protect the user's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
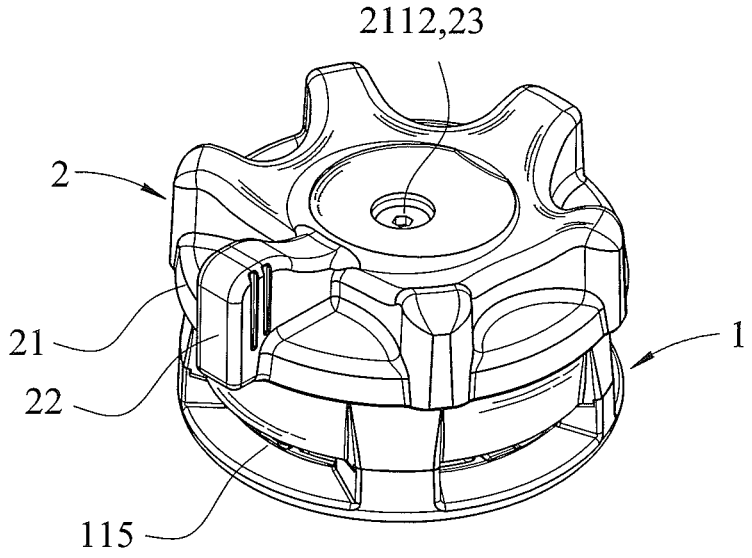
FIG. 1 is a perspective view of a safety belt buckle in accordance with the preferred embodiment of the present invention.
Figure 2:
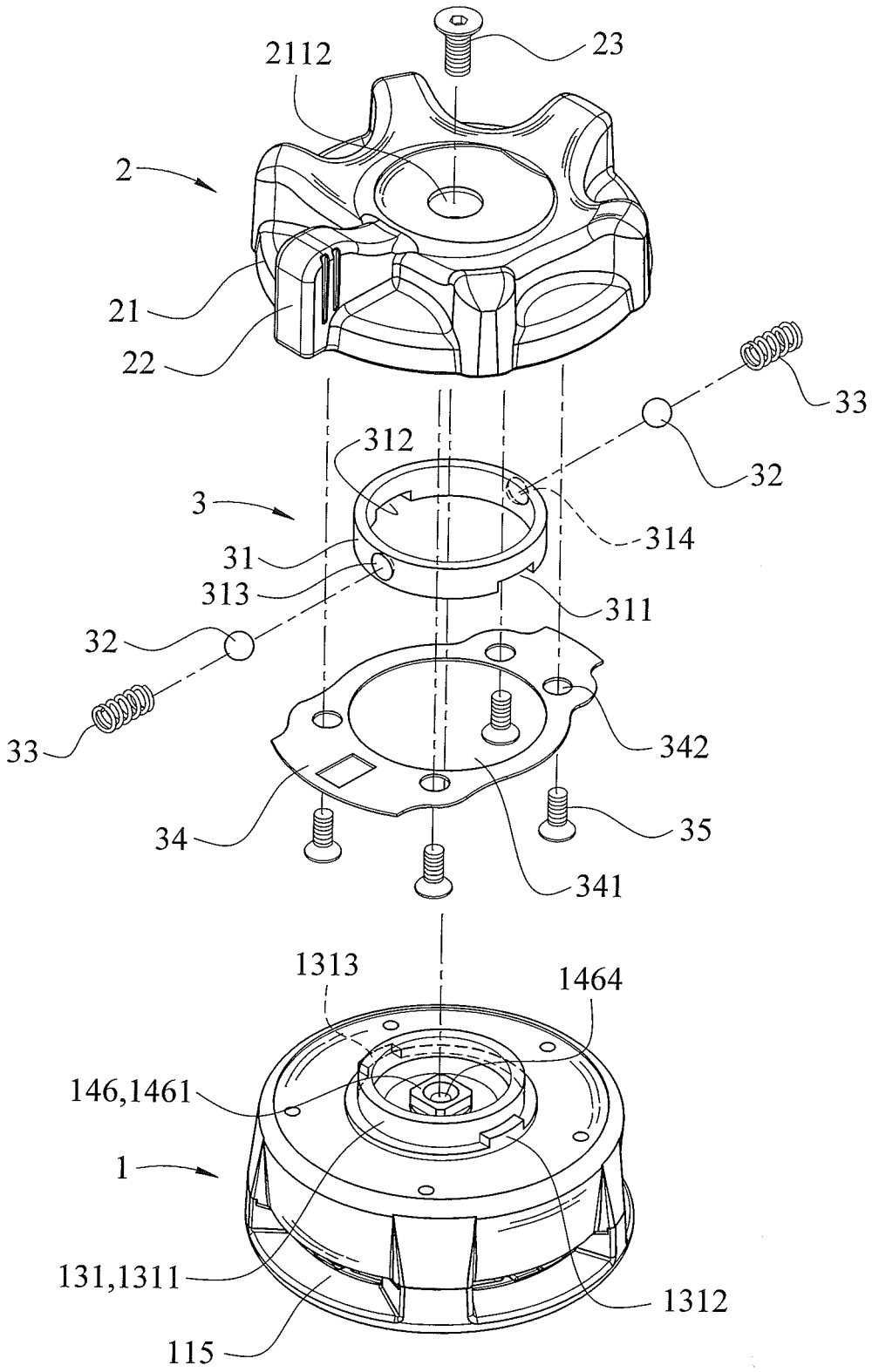
FIG. 2 is a partially exploded perspective view of the safety belt buckle as shown in FIG. 1.
Figure 3:
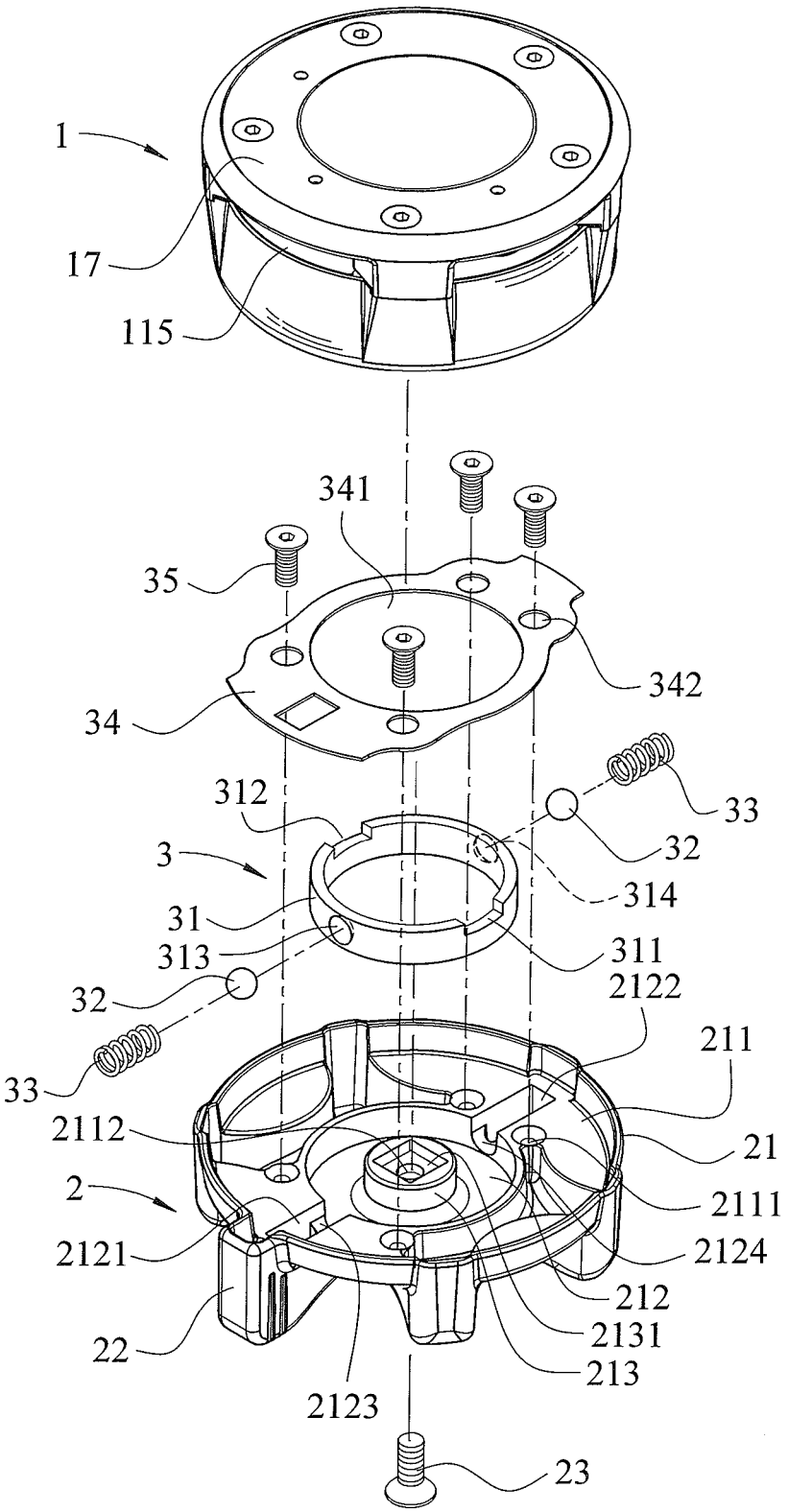
FIG. 3 is another partially exploded perspective view of the safety belt buckle as shown in FIG. 1.
Figure 4:
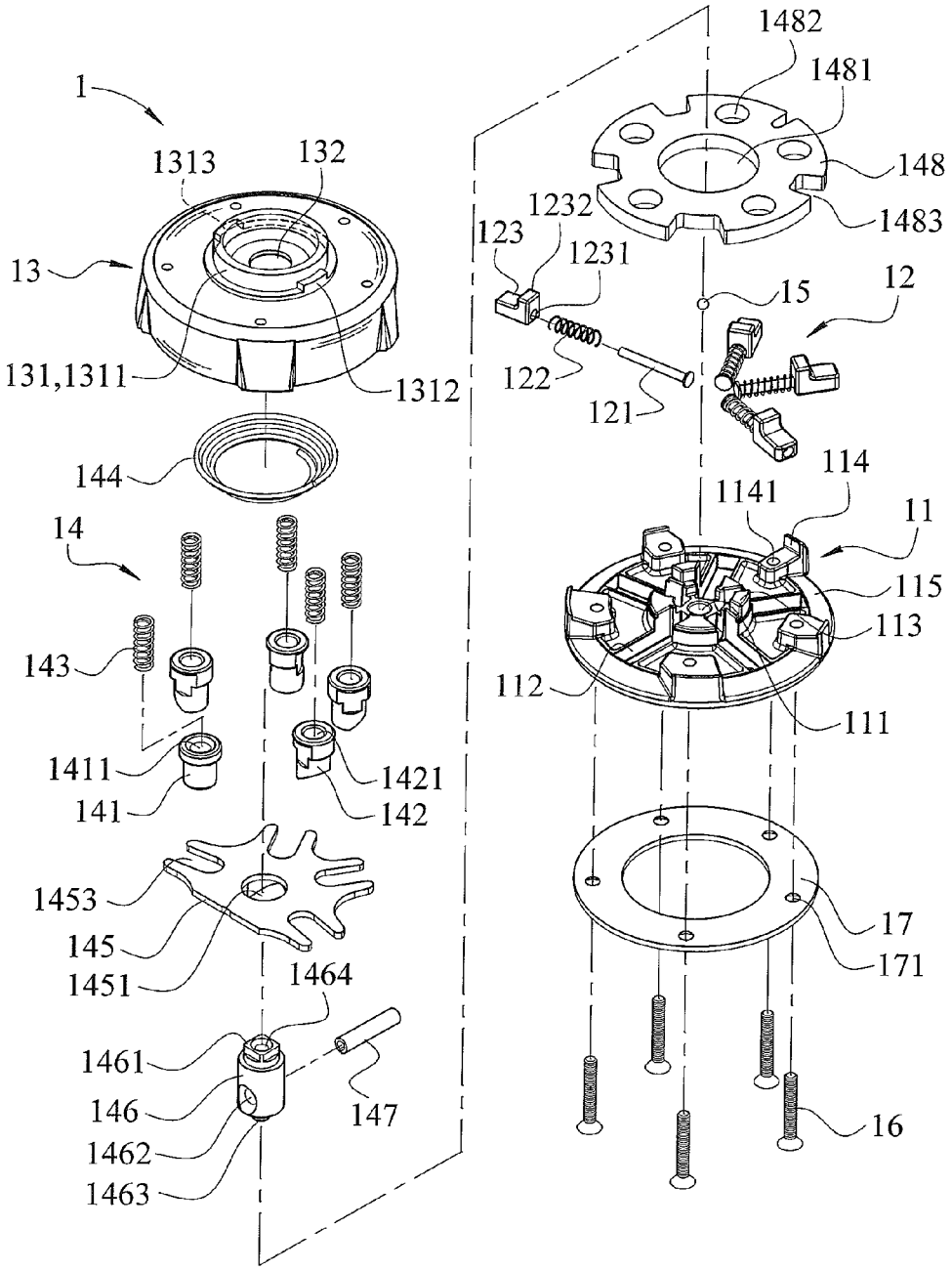
FIG. 4 is an exploded perspective view of a base unit of the safety belt buckle in accordance with the preferred embodiment of the present invention.
Figure 5:
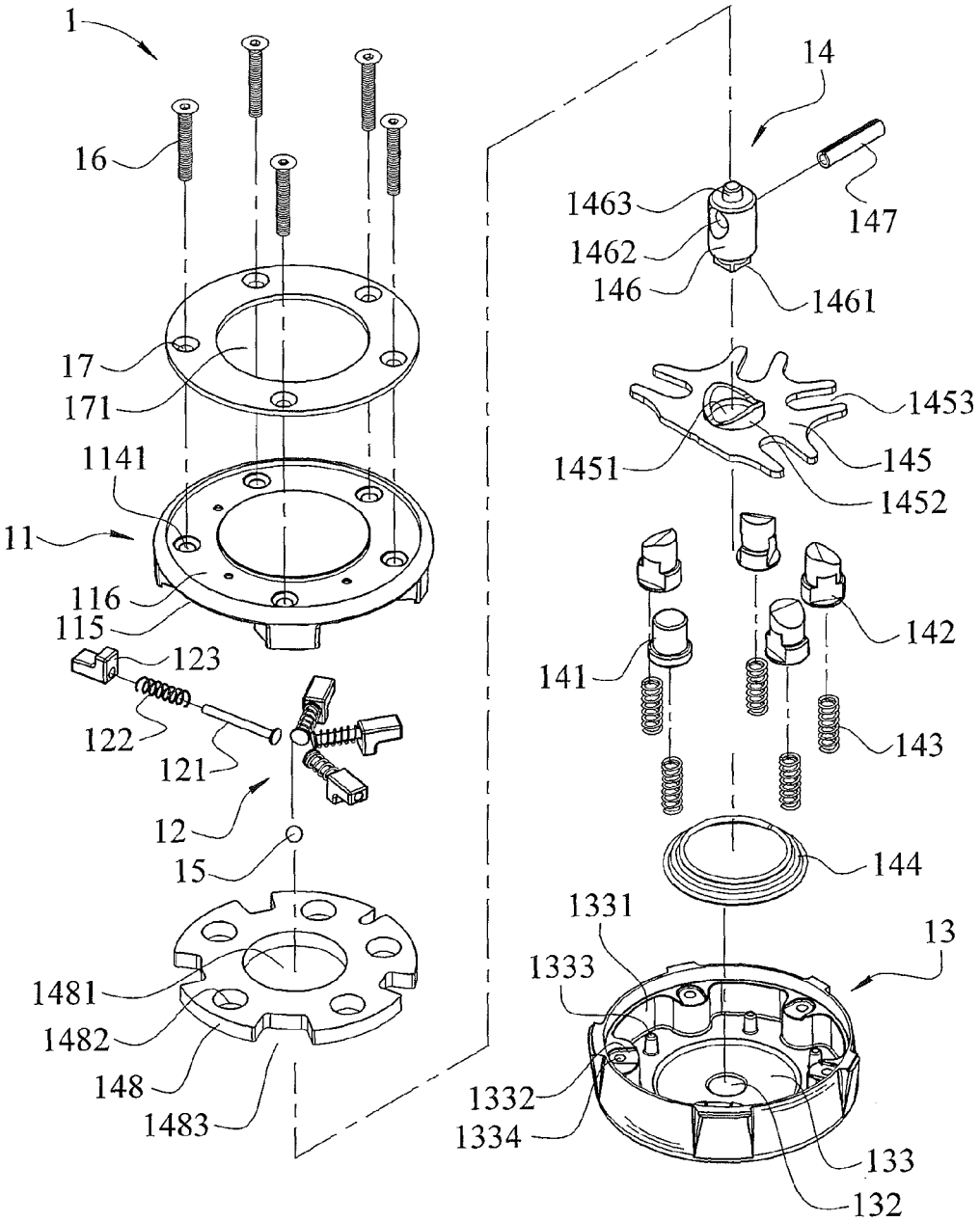
FIG. 5 is another exploded perspective view of the base unit of the safety belt buckle in accordance with the preferred embodiment of the present invention.

Referring to the drawings and initially to FIGS. 1-5, a safety belt buckle in accordance with the preferred embodiment of the present invention comprises a base unit 1, a driving unit 2 mounted on the base unit 1, and a torque device 3 mounted on the driving unit 2.

The base unit 1 is provided with a plurality of insertion slots 115, a rotation shaft 146, and a positioning portion 131. The rotation shaft 146 has a top provided with a drive portion 1461. The positioning portion 131 has an annular wall 1311 surrounding the rotation shaft 146. The annular wall 1311 of the positioning portion 131 has a height greater than that of the drive portion 1461 of the rotation shaft 146 and has a periphery provided with a first protrusion 1312 and a second protrusion 1313 protruding outward. The base unit 1 has a bottom provided with an annular groove 116 for mounting an annular block 17. Preferably, the annular block 17 is made of metallic material that is selected from any one of copper, stainless steel, aluminum, zinc or iron. Thus, the annular block 17 enhances the whole strength of the base unit 1.

The driving unit 2 covers a top of the base unit 1 and includes a circular cap 21 and a driving handle 22 extending from the circular cap 21. The circular cap 21 of the driving unit 2 has a bottom provided with a receiving chamber 211. The receiving chamber 211 of the circular cap 21 has a center provided with a receiving recess 212 corresponding to the annular wall 1311 of the positioning portion 131. The receiving recess 212 of the circular cap 21 has a periphery provided with a first channel 2121 and a second channel 2122 and has a center provided with a cylindrical fixing portion 213.

The torque device 3 includes a ring 31 mounted in the receiving recess 212 of the circular cap 21 and having a periphery provided with a first depression 311, a second depression 312, a first ball groove 313 and a second ball groove 314, two balls 32 respectively mounted in the first channel 2121 and the second channel 2122 of the circular cap 21 and partially received in the first ball groove 313 and the second ball groove 314 of the ring 31 respectively, two compression springs 33 respectively mounted in the first channel 2121 and the second channel 2122 of the circular cap 21 and biased between the circular cap 21 of the driving unit 2 and the two balls 32 respectively, and a fixed plate 34 secured in the receiving chamber 211 of the circular cap 21 and provided with a connecting hole 341 corresponding to the annular wall 1311 of the positioning portion 131.

In practice, when the driving handle 22 of the driving unit 2 is driven by a user, the circular cap 21 of the driving unit 2 is rotated to operate the two compression springs 33 which press the two balls 32 of the torque device 3 to increase a resistance to the circular cap 21 of the driving unit 2, and to obstruct rotation of the driving unit 2, thereby preventing the driving unit 2 from being driven freely by an external force.

In the preferred embodiment of the present invention, the receiving chamber 211 of the circular cap 21 is provided with a plurality of locking holes 2111, the fixed plate 34 of the torque device 3 is provided with a plurality of through holes 342, and the torque device 3 further includes a plurality of fastening members 35 extending through the through holes 342 of the fixed plate 34 and locked into the locking holes 2111 of the circular cap 21 to secure the fixed plate 34 to the circular cap 21, so that the torque device 3 is affixed to the driving unit 2.

In the preferred embodiment of the present invention, the first depression 311 and the second depression 312 of the ring 31 are mounted on the first protrusion 1312 and the second protrusion 1313 of the positioning portion 131, to secure the ring 31 of the torque device 3 to the positioning portion 131 of the base unit 1.

In the preferred embodiment of the present invention, each of the first ball groove 313 and the second ball groove 314 has a semi-circular shape.

In the preferred embodiment of the present invention, the receiving recess 212 and the first channel 2121 of the circular cap 21 have an intersection which is provided with a first arcuate groove 2123 for receiving one of the two balls 32 in the first ball groove 313 of the ring 31, and the receiving recess 212 and the second channel 2122 of the circular cap 21 have an intersection which is provided with a second arcuate groove 2124 for receiving one of the two balls 32 in the second ball groove 314 of the ring 31.

In the preferred embodiment of the present invention, the fixing portion 213 of the circular cap 21 has a center provided with a locking recess 2131 locked onto the drive portion 1461 of the rotation shaft 146. Preferably, the drive portion 1461 of the rotation shaft 146 has a square shape, and the locking recess 2131 of the circular cap 21 also has a square shape. In addition, the circular cap 21 of the driving unit 2 has a top provided with a through hole 2112 connected to the locking recess 2131 of the circular cap 21, the drive portion 1461 of the rotation shaft 146 has a top provided with a screw hole 1464, and the driving unit 2 further includes a fastening element 23 extending through the through hole 2112 of the circular cap 21 and screwed into the screw hole 1464 of the drive portion 1461.

In the preferred embodiment of the present invention, the base unit 1 includes a support base 11 having a top provided with a plurality of slideways 112, a plurality of elastic modules 12 mounted in the slideways 112 of the support base 11, a top cover 13 mounted on the support base 11, and a locking device 14 mounted in the top cover 13. The positioning portion 131 of the base unit 1 is arranged on a top of the top cover 13.

The top of the support base 11 has a center provided with a recessed flange 111, and each of the slideways 112 extends from the recessed flange 111 to a periphery of the support base 11. The slideways 112 of the support base 11 are arranged in a radiating manner. The support base 11 is provided with a plurality of abutting pieces 113 surrounding the recessed flange 111 and arranged in a circular manner. The periphery of the support base 11 is provided with a plurality of spacing blocks 114, and the insertion slots 115 are formed in the periphery of the support base 11 and located between the spacing blocks 114. The spacing blocks 114 of the support base 11 are arranged in a radiating manner.

The top of the top cover 13 has a center provided with a shaft hole 132 located in the annular wall 1311 of the positioning portion 131, and the drive portion 1461 of the rotation shaft 146 passes through the shaft hole 132 of the top cover 13. The top cover 13 has a bottom provided with a receiving space 133 connected to the shaft hole 132. The receiving space 133 of the top cover 13 is provided with a plurality of convex portions 1332, a plurality of concave portions 1331 located between the convex portions 1332, and a plurality of pillars 1333 located in the concave portions 1331.

The locking device 14 is mounted in the receiving space 133 of the top cover 13 and includes a fixed post 141 mounted on one of the pillars 1333 of the top cover 13, a plurality of movable posts 142 mounted on the pillars 1333 of the top cover 13 and corresponding to the elastic modules 12 of the base unit 1, a plurality of springs 143 mounted on the pillars 1333 of the top cover 13 and located in the fixed post 141 and the movable posts 142, a conical spring 144 mounted in the receiving space 133 of the top cover 13 and corresponding to the shaft hole 132 of the top cover 13, a driven plate 145 mounted in the receiving space 133 of the top cover 13 and abutting the conical spring 144, the rotation shaft 146 extending through the driven plate 145, and a fixed disk 148 arranged under the driven plate 145 and abutting the spacing blocks 114 of the support base 11.

The driven plate 145 of the locking device 14 has a central portion provided with a through hole 1451 and a hollow lug 1452 and has a rim provided with a plurality of clamping grooves 1453 for clamping the movable posts 142. The hollow lug 1452 of the driven plate 145 has a notch. The rotation shaft 146 of the locking device 14 extends through the through hole 1451 of the driven plate 145 and is provided with a pivot hole 1462, and the locking device 14 further includes a pin 147 extending through the pivot hole 1462 of the rotation shaft 146 and abutting the hollow lug 1452 of the driven plate 145. The rotation shaft 146 has a bottom provided with an abutting stub 1463 inserted into the recessed flange 111 of the support base 11. The base unit 1 further includes a ball 15 received in the recessed flange 111 of the support base 11 and located between the recessed flange 111 of the support base 11 and the abutting stub 1463 of the rotation shaft 146. The fixed disk 148 of the locking device 14 has a central portion provided with a retaining hole 1481 to allow insertion of the abutting pieces 113 of the support base 11 so as to position the fixed disk 148. The fixed disk 148 of the locking device 14 has a periphery provided with a plurality of passages 1482 corresponding to the slideways 112 of the support base 11. The fixed disk 148 of the locking device 14 has a rim provided with a plurality of openings 1483. The fixed post 141 and the movable posts 142 of the locking device 14 extend through the passages 1482 of the fixed disk 148. The fixed post 141 of the locking device 14 has an end provided with an interior hole 1411 for mounting one of the springs 143. Each of the movable posts 142 of the locking device 14 has an end provided with an interior hole 1421 for mounting one of the springs 143. The conical spring 144 of the locking device 14 abuts a top of the receiving space 133 of the top cover 13.

Each of the elastic modules 12 of the base unit 1 includes a support rod 121, a slide 123 mounted on the support rod 121 and having a side provided with a stop 1232 abutting one of the movable posts 142, and a tensile spring 122 mounted on the support rod 121 and biased between the support rod 121 and the slide 123. The slide 123 of each of the elastic modules 12 is provided with an aperture 1231 mounted on the support rod 121.

In the preferred embodiment of the present invention, the base unit 1, the annular block 17 and the top cover 13 are combined by screwing. Each of the spacing blocks 114 of the support base 11 is provided with a first bore 1141, the annular block 17 is provided with a plurality of second bores 171, each of the convex portions 1332 of the top cover 13 is provided with a locking bore 1334, and the base unit 1 further includes a plurality of fastener members 16 each extending through each of the second bores 171 of the annular block 17 and the first bore 1141 of each of the spacing blocks 114, and each screwed into the locking bore 1334 of each of the convex portions 1332.

Figure 6:
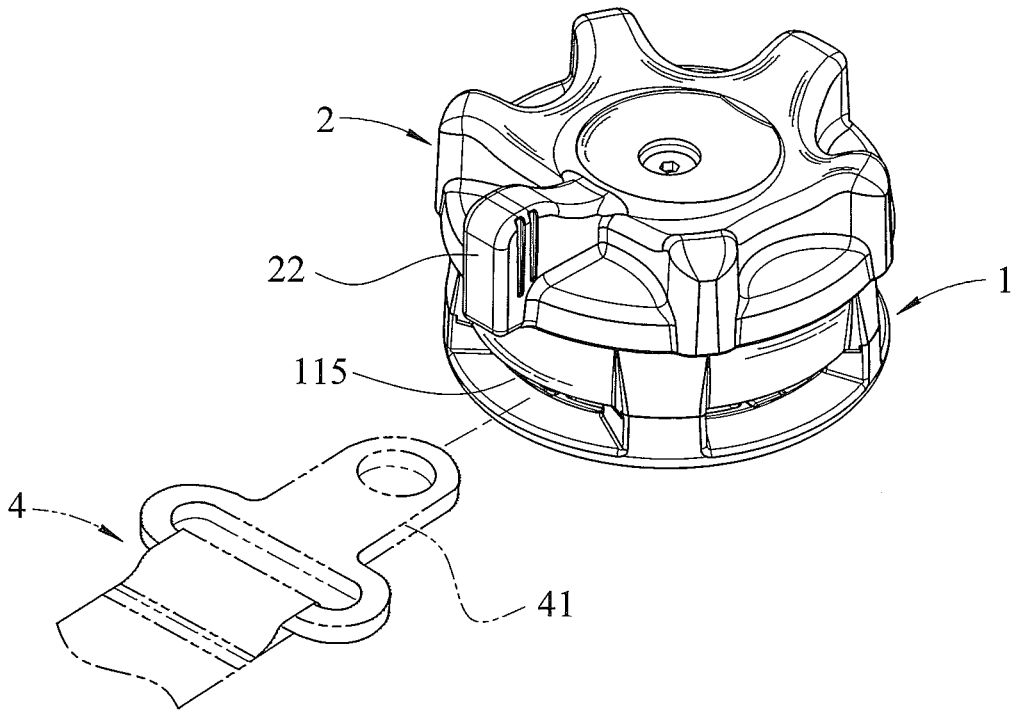
FIG. 6 is a schematic operational view of the safety belt buckle for a safety belt as shown in FIG. 1 in use.
Figure 7:
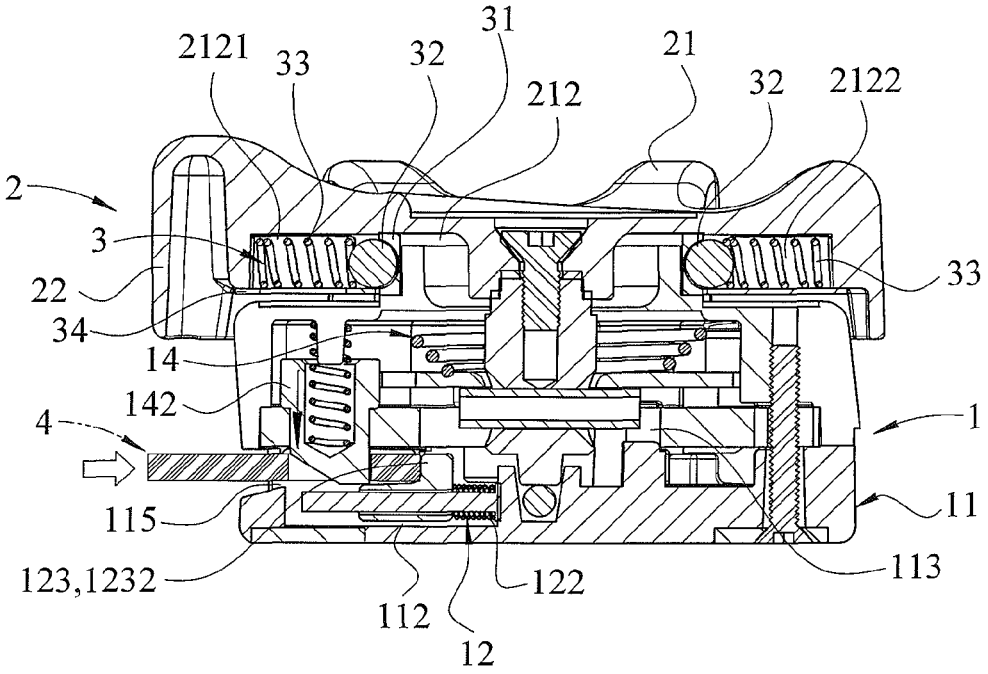
FIG. 7 is a cross-sectional view showing the safety belt being locked onto the safety belt buckle.

In operation, referring to FIGS. 6-9 with reference to FIGS. 1-5, when a latch plate 41 of a safety belt 4 is inserted into one of the insertion slots 115 of the base unit 1 as shown in FIG. 6, the stop 1232 of the slide 123 of one of the elastic modules 12 is pushed by the latch plate 41 of the safety belt 4 to compress the tensile spring 122, so that the slide 123 is moved inward in one of the slideways 112 of the support base 11. In such a manner, one of the movable posts 142 of the locking device 14 is released from the stop 1232 of the slide 123 and is pushed downward by the restoring force of one of the springs 143 to lock a hole (not labeled) of the latch plate 41, so that the latch plate 41 of the safety belt 4 is locked by one of the movable posts 142 of the locking device 14 and retained by the slide 123 of one of the elastic modules 12 as shown in FIG. 7.

Figure 8:
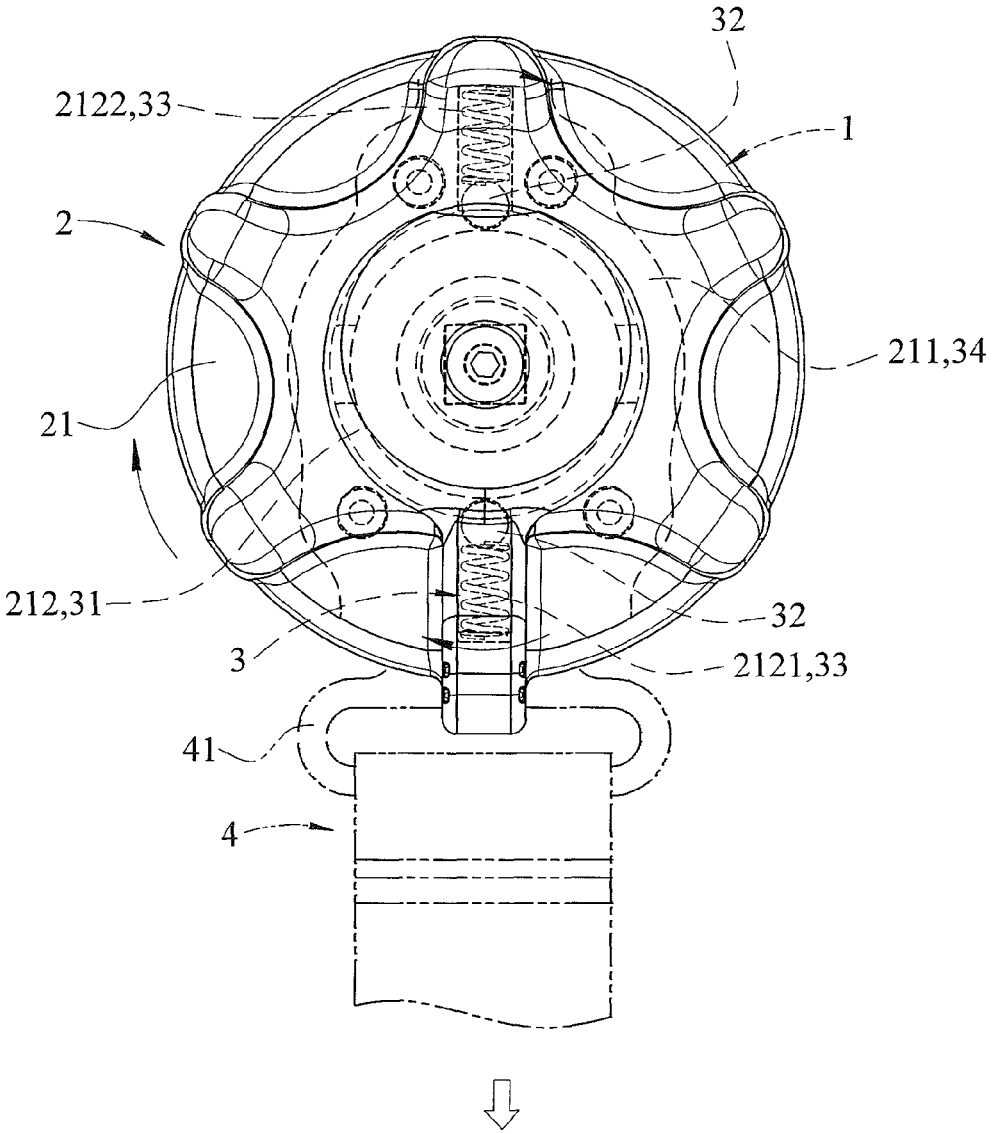
FIG. 8 is a top view showing the circular cap of the driving unit being rotated.

On the contrary, when the driving handle 22 of the driving unit 2 is driven, the circular cap 21 of the driving unit 2 is rotated as shown in FIG. 8 to spin the rotation shaft 146 of the locking device 14. At this time, the pin 147 of the rotation shaft 146 initially abuts the notch of the hollow lug 1452 of the driven plate 145. When the rotation shaft 146 of the locking device 14 is rotated, the pin 147 of the rotation shaft 146 is moved toward an edge of the hollow lug 1452 to push the driven plate 145 upward and to compress the conical spring 144, so that each of the movable posts 142 of the locking device 14 is moved upward by the driven plate 145 to release the latch plate 41 of the safety belt 4, and each of the springs 143 is compressed. In such a manner, after the latch plate 41 of the safety belt 4 is unlocked from one of the movable posts 142 of the locking device 14, the latch plate 41 of the safety belt 4 and the slide 123 of one of the elastic modules 12 are pushed outward by the restoring force of the tensile spring 122, so that the latch plate 41 of the safety belt 4 is detached from one of the insertion slots 115 of the base unit 1 as shown in FIG. 9.

It is to be noted that, when the circular cap 21 of the driving unit 2 is rotated to operate the two compression springs 33 of the torque device 3, the two compression springs 33 press the two balls 32 of the torque device 3 and are twisted rightward and leftward to increase the resistance to the circular cap 21 of the driving unit 2, and to obstruct rotation of the driving unit 2, thereby preventing the driving unit 2 from being driven freely by an external force, so that the user has to exert a determined force to drive and rotate the driving unit 2.

Figure 9:
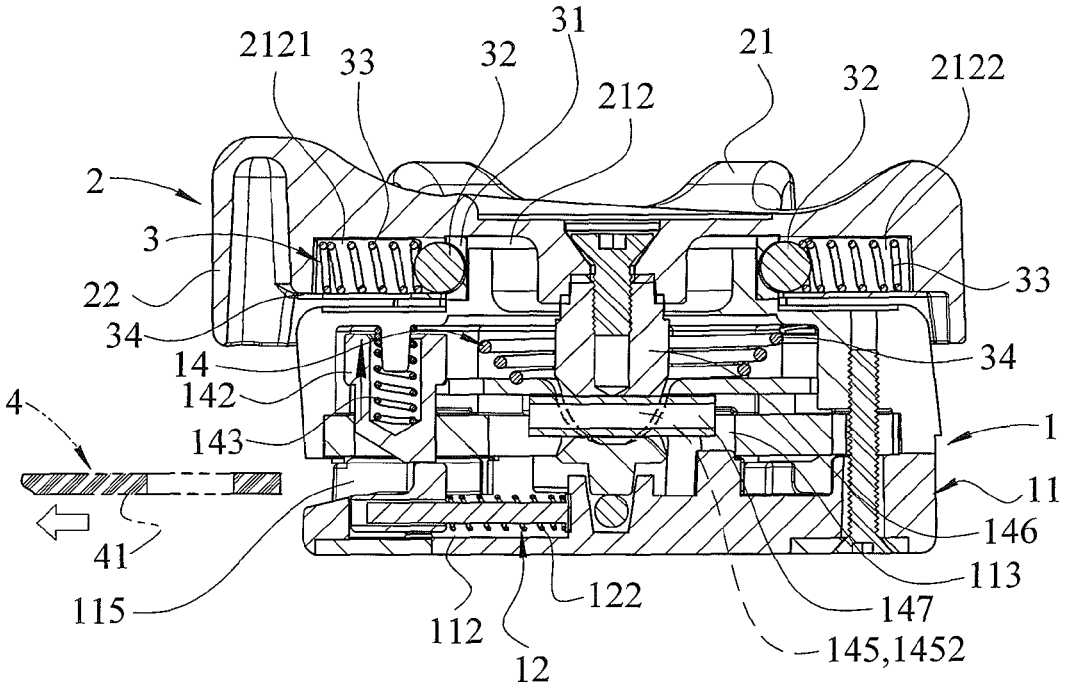
FIG. 9 is a cross-sectional view showing the safety belt being unlocked and detached from the safety belt buckle.

After the latch plate 41 of the safety belt 4 is released from the base unit 1, the driven plate 145 is pushed by the restoring force of the conical spring 144 to return to the original position, the slide 123 of one of the elastic modules 12 is pushed by the restoring force of the tensile spring 122 to return to the original position, and the movable posts 142 are pushed by the restoring force of the springs 143 to return to the original position as shown in FIG. 9, so that the stop 1232 of the slide 123 of one of the elastic modules 12 presses one of the movable posts 142 again, and the rotation shaft 146 and the driving unit 2 are driven to rotate reversely to the original position.

Accordingly, the user has to apply a determined force to overcome the resistance of the two compression springs 33 and to drive the driving unit 2, so as to release the latch plate 41 of the safety belt 4, thereby preventing the driving unit 2 from being driven freely by an external force due to an unintentional touch or hit, and thereby preventing the latch plate 41 of the safety belt 4 from being unlatched easily, so as to protect the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A safety belt buckle comprising:

a base unit;

a driving unit mounted on the base unit; and a torque device mounted on the driving unit;

wherein:

the base unit is provided with a plurality of insertion slots, a rotation shaft, and a positioning portion;

the rotation shaft has a top provided with a drive portion;

the positioning portion has an annular wall surrounding the rotation shaft;

the annular wall of the positioning portion has a height greater than that of the drive portion of the rotation shaft and has a periphery provided with a first protrusion and a second protrusion;

the driving unit includes:

a circular cap; and a driving handle extending from the circular cap;

the circular cap of the driving unit has a bottom provided with a receiving chamber;

the receiving chamber of the circular cap is provided with a receiving recess corresponding to the annular wall of the positioning portion;

the receiving recess of the circular cap has a periphery provided with a first channel and a second channel and has a center provided with a fixing portion;

the torque device includes:

a ring mounted in the receiving recess of the circular cap and having a periphery provided with a first depression, a second depression, a first ball groove and a second ball groove;

two balls respectively mounted in the first channel and the second channel of the circular cap and partially received in the first ball groove and the second ball groove of the ring respectively;

two compression springs respectively mounted in the first channel and the second channel of the circular cap and biased between the circular cap of the driving unit and the two balls respectively; and a fixed plate secured in the receiving chamber of the circular cap and provided with a connecting hole corresponding to the annular wall of the positioning portion; and when the driving handle of the driving unit is driven by a user, the circular cap of the driving unit is rotated to operate the two compression springs which press the two balls of the torque device to increase a resistance to the circular cap of the driving unit, and to obstruct rotation of the driving unit, thereby preventing the driving unit from being driven freely by an external force.

2. The safety belt buckle of claim 1, wherein the receiving chamber of the circular cap is provided with a plurality of locking holes, the fixed plate of the torque device is provided with a plurality of through holes, and the torque device further includes a plurality of fastening members extending through the through holes of the fixed plate and locked into the locking holes of the circular cap.

3. The safety belt buckle of claim 1, wherein the first depression and the second depression of the ring are mounted on the first protrusion and the second protrusion of the positioning portion, to secure the ring of the torque device to the positioning portion of the base unit.

4. The safety belt buckle of claim 1, wherein each of the first ball groove and the second ball groove has a semi-circular shape.

5. The safety belt buckle of claim 1, wherein the receiving recess and the first channel of the circular cap have an intersection which is provided with a first arcuate groove for receiving a first one of the two balls in the first ball groove of the ring.

6. The safety belt buckle of claim 5, wherein the receiving recess and the second channel of the circular cap have an intersection which is provided with a second arcuate groove for receiving a second one of the two balls in the second ball groove of the ring.

7. The safety belt buckle of claim 1, wherein the fixing portion of the circular cap has a center provided with a locking recess locked onto the drive portion of the rotation shaft.

8. The safety belt buckle of claim 7, wherein the circular cap of the driving unit has a top provided with a through hole connected to the locking recess of the circular cap, the drive portion of the rotation shaft has a top provided with a screw hole, and the driving unit further includes a fastening element extending through the through hole of the circular cap and screwed into the screw hole of the drive portion.

9. The safety belt buckle of claim 1, wherein the base unit has a bottom provided with an annular groove for mounting an annular block.

* * * * *